US009877616B2

(12) United States Patent
Vegh

(10) Patent No.: US 9,877,616 B2
(45) Date of Patent: Jan. 30, 2018

(54) LIQUID SOAP FILLING DEVICE

(71) Applicant: Larry Vegh, Chandler, AZ (US)

(72) Inventor: Larry Vegh, Chandler, AZ (US)

( * ) Notice: Subject to any disclaimer, the term of this patent is extended or adjusted under 35 U.S.C. 154(b) by 97 days.

(21) Appl. No.: 14/990,581

(22) Filed: Jan. 7, 2016

(65) Prior Publication Data

US 2016/0194098 A1 Jul. 7, 2016

Related U.S. Application Data

(60) Provisional application No. 62/100,744, filed on Jan. 7, 2015.

(51) Int. Cl.
*A47K 5/12* (2006.01)
*B65B 3/06* (2006.01)

(52) U.S. Cl.
CPC ..... *A47K 5/12* (2013.01); *A47K 2005/1218* (2013.01); *B65B 3/06* (2013.01)

(58) Field of Classification Search
CPC . B67C 11/04; B67C 2011/027; B67D 3/0032; A47K 5/12; A47K 5/1201; A47K 2005/1218
USPC ..... 141/2, 340, 363, 364; 222/23, 105, 184
See application file for complete search history.

(56) References Cited

U.S. PATENT DOCUMENTS 4,099,654 A * 7/1978 Antolino ..... A47J 43/284 141/344
4,331,189 A * 5/1982 Joyner ..... A47J 43/284 141/331
5,297,476 A * 3/1994 Garland ..... A47J 43/284 141/331
7,377,210 B1 * 5/2008 Franco ..... A47J 37/1271 141/340
7,753,087 B2 * 7/2010 Rhodenbaugh ..... A47K 5/1204 141/18
8,800,815 B1 * 8/2014 Butler ..... A47K 5/1208 141/114
2005/0224138 A1 * 10/2005 Guthrie ..... F16L 11/18 141/340
2011/0215115 A1 * 9/2011 Proper ..... B67D 7/76 222/173
2014/0231452 A1 * 8/2014 James ..... B65D 75/5883 222/105
2014/0263421 A1 * 9/2014 Urban ..... A47K 5/12 222/23

* cited by examiner

*Primary Examiner* — Timothy L Maust

(74) *Attorney, Agent, or Firm* — Schmeiser, Olsen & Watts LLP

(57) ABSTRACT

A liquid soap filling device is provided. The liquid soap filling device includes a body member having an upper portion and lower portion. The upper portion includes an inner volume accessible through an opening in a top surface of the upper portion. The inner volume receives a measured amount of liquid soap through the opening. The lower portion includes a frustoconical shaped inner volume and a valve system, wherein the valve system controls the dispensing of the liquid soap from within the inner volume of the upper portion through the frustoconical shaped inner volume of the lower portion and through a fill port of the lower portion and into an under-counter dispenser container.

4 Claims, 6 Drawing Sheets

LIQUID SOAP FILLING DEVICE

CROSS REFERENCE TO RELATED APPLICATION[S]

This application claims priority to U.S. Provisional Patent Application entitled "LIQUID SOAP FILLING DEVICE," Ser. No. 62/100,744, filed Jan. 7, 2015, the disclosure of which is hereby incorporated entirely herein by reference.

BACKGROUND OF THE INVENTION

Technical Field

This invention relates generally to liquid soap filling device and more particularly to a liquid soap filling device for filling under-counter mount liquid soap dispenser with a premeasured amount of liquid soap.

State of the Art

The use of liquid soap is abundant and various types of dispensers are utilized. There are dispensers that rest on the counter, dispensers that mount on a wall, dispensers that are mounted under a counter with a nozzle portion extending above the counter and the like. The refilling of these dispensers is performed manually by a user pouring in liquid soap through a fill opening in the container and visually determining when to stop the filling process. This is very difficult to perform a visual determination of liquid soap volume in a container that is mounted under a counter top. Further, because it is under the counter top, directing the liquid soap into the fill opening is also difficult. Often a user, when filling an under-counter mounted container, will over fill, under fill and/or spill onto the counter top. This must all be done with the user holding the refill container and carefully pouring the liquid soap into the dispensing container.

Accordingly, there is a need in the field of liquid soap filling devices for an improved device to fill under-counter mounted liquid soap dispensers.

SUMMARY OF THE INVENTION

The present invention relates to a liquid soap filling device for use with under-counter mounted liquid soap dispensers. The filling device allows for retaining a measured amount of liquid soap and transferring the liquid soap into a dispenser container through a fill opening in the container without the need for visual determination of the amount of liquid soap within the container. Further, the filling device does not require a user to hold the device during filling.

An embodiment of a liquid soap filling device comprises a body member having an upper portion and lower portion. The upper portion comprises an inner volume accessible through an opening in a top surface of the upper portion. The inner volume receives a measured amount of liquid soap through the opening. The lower portion comprises a frustoconical shaped inner volume and a valve system, wherein the valve system controls the dispensing of the liquid soap from within the inner volume of the upper portion through the frustoconical shaped inner volume of the lower portion and through a fill port of the lower portion and into an under-counter dispenser container.

Another embodiment includes a method of using a liquid soap filling device; the method comprising: filling the liquid soap filling device, with the liquid soap filling device in a closed condition with liquid soap until the liquid soap reaches a predetermined measured amount; placing the liquid soap filling device in fluid communication with a liquid soap dispenser container installed under a countertop; placing the liquid soap filling device in an open condition; and filling the liquid soap dispenser container.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
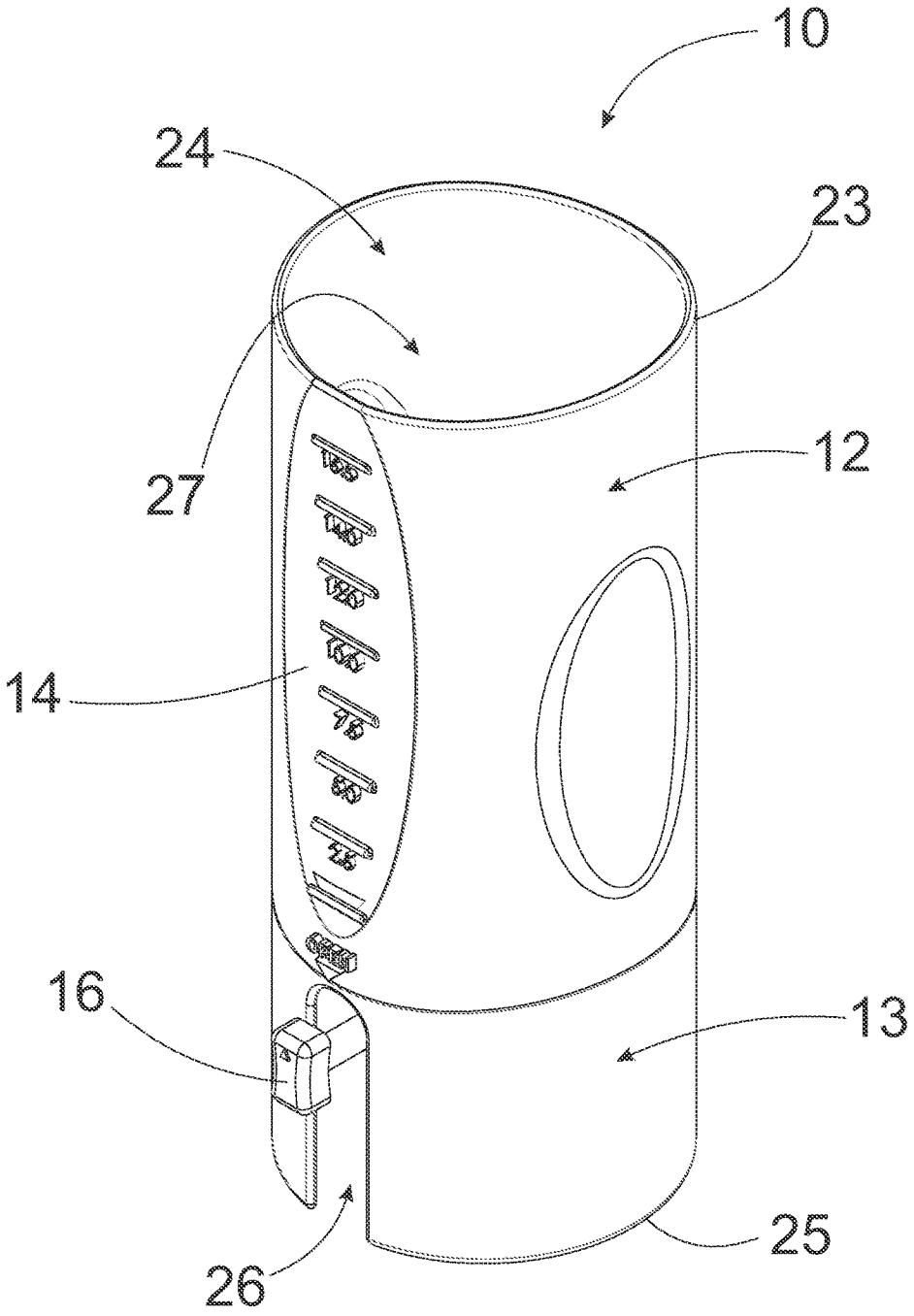
FIG. 1 is a perspective view of a liquid soap filling device, in accordance with embodiments of the invention.
Figure 2:
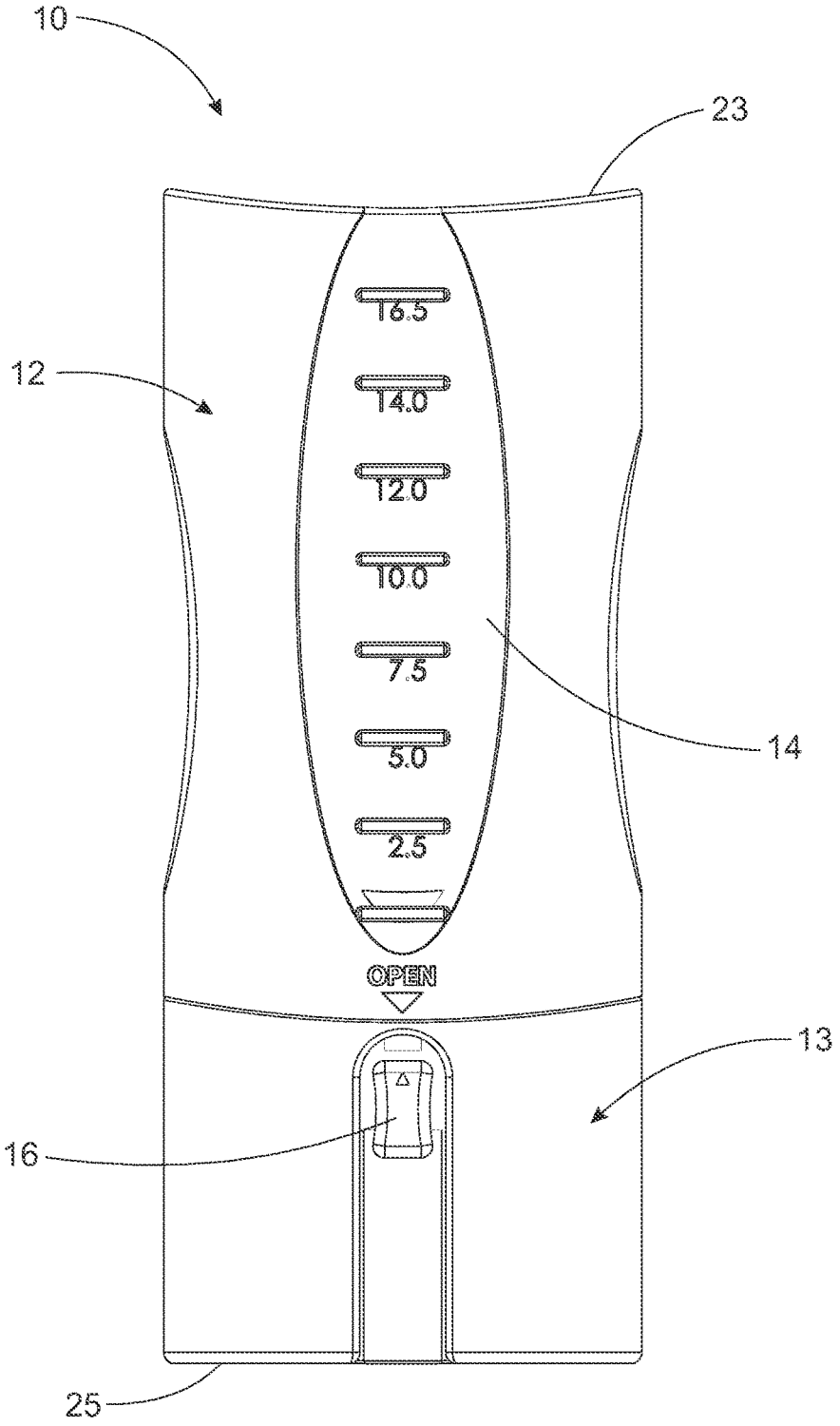
FIG. 2 is a front view of a liquid soap filling device, in accordance with embodiments of the invention.
Figure 3:
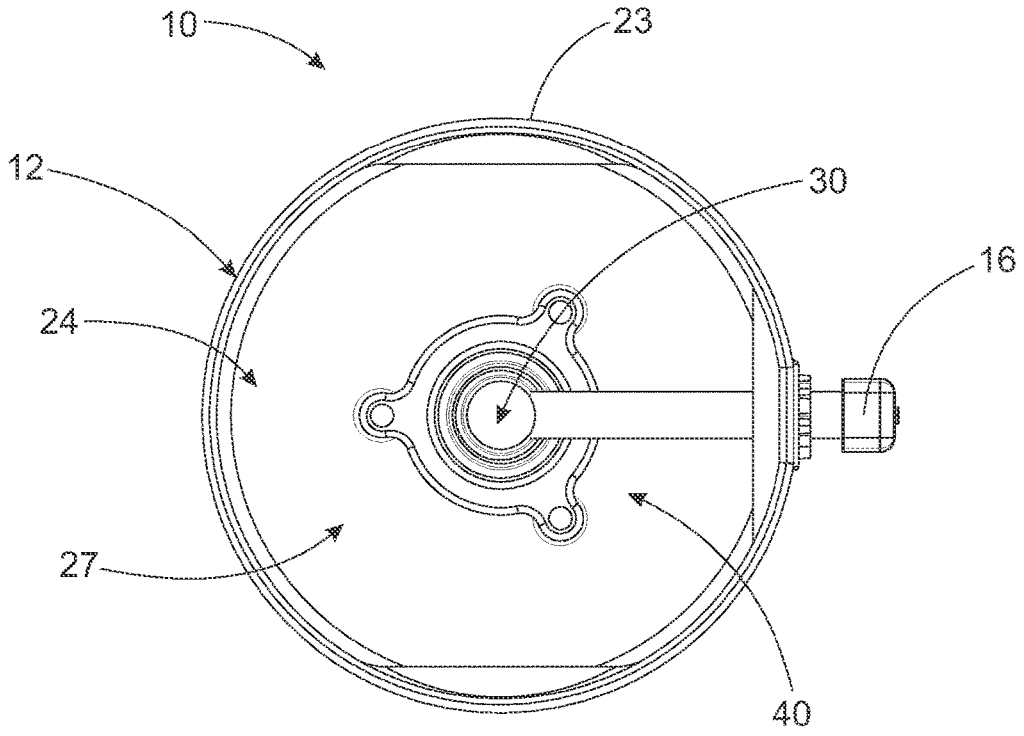
FIG. 3 is a top view of a liquid filling device, in accordance with embodiments of the invention.
Figure 4:
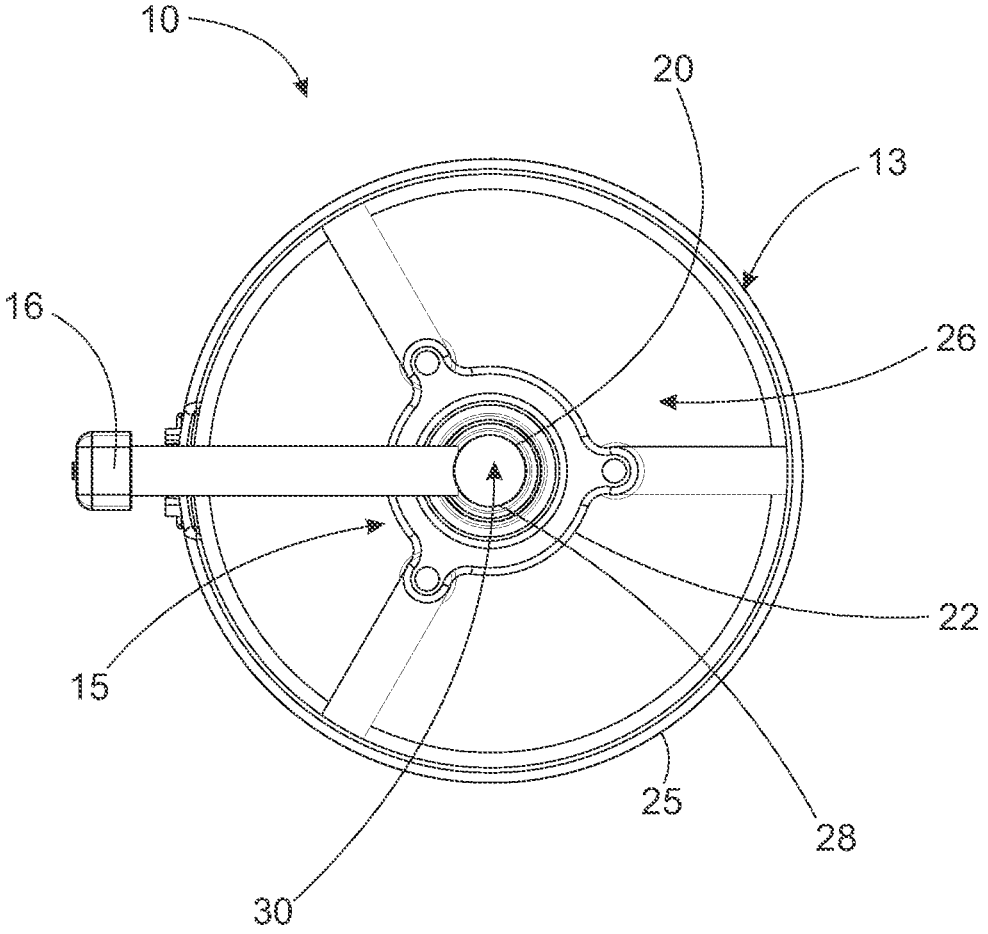
FIG. 4 is a bottom view of a liquid filling device, in accordance with embodiments of the invention.
Figure 5:
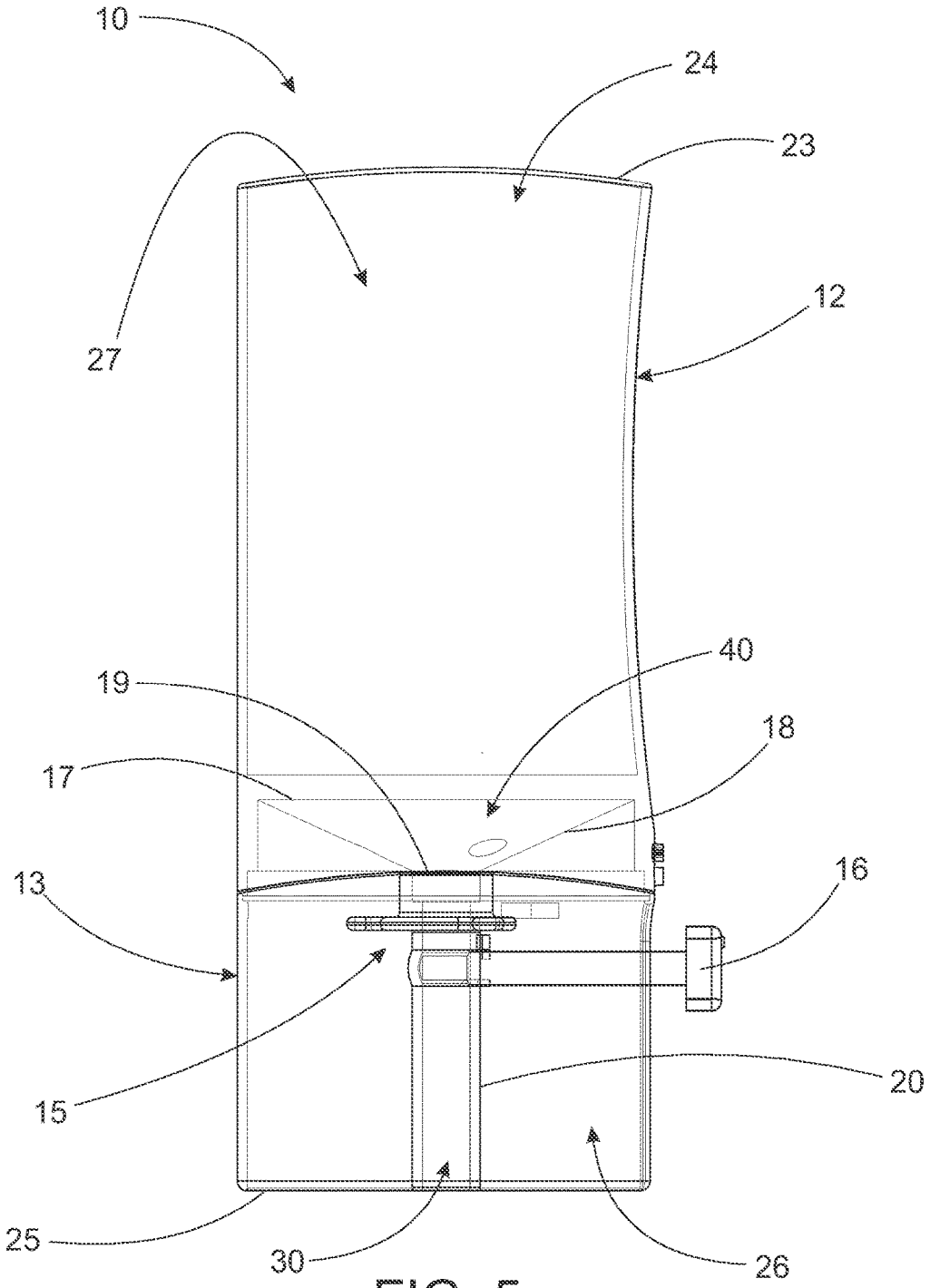
FIG. 5 is a section view of a liquid filling device, in accordance with embodiments of the invention.

As discussed above, embodiments of the present invention relate to a liquid soap filling device for use with under-counter mounted liquid soap dispensers. The filling device allows for retaining a measured amount of liquid soap and transferring the liquid soap into a dispenser container through a fill opening in the container without the need for visual determination of the amount of liquid soap within the container. Further, the filling device does not require a user to hold the device during filling.

Referring to the drawings, FIGS. 1-5 depict views of a liquid soap filling device 10 in accordance with an embodiment. Filling device 10 includes a body member 12 formed of an upper portion 11 coupled to a lower portion 13. Upper portion 11 includes a top surface 23 and an inner volume 27 that is accessible through an opening 24 in top surface 23. Upper portion 11 further includes a window 14. According to some embodiments, upper portion 11 may include a volume indicator on or adjacent window 14. In use, upper portion 11 may receive liquid soap within inner volume 27 through opening 24. A volume of liquid soap may be determined by filling inner volume 27 with liquid soap until a level of liquid soap reaches a predetermined measured amount corresponding to volume indicator. In at least this way, inner volume 27 of upper portion 11 is filled with measured liquid soap.

Lower portion 13 of filling device 10 comprises a frustoconical inner volume 40 having a first opening 17 that corresponds to a size of inner volume 27 and a second opening 19 having a smaller size than first opening 17 and a surface 18 extending from the first opening 17 to the second opening 19 to form the frustoconical shape of frustoconical inner volume 40. In some embodiments, filling device 10 is cylindrical in shape and inner volume 27 is cylindrical in shape. Inner volume of upper portion 11 is in fluid communication with inner volume 40 of lower portion 13. Accordingly, liquid soap received within inner volume 27 of upper portion 11 flows into inner volume 40 of lower portion 13.

Lower portion 13 further comprises a bottom surface 25, a tube portion 20 extending through an open space 26 extending from bottom surface 25, and a valve 15. Valve 15 is coupled between frustoconical inner volume 40 and tube portion 20. Inner volume 40 of lower portion 13 is in fluid communication with tube portion 20. Valve 15 operates to control flow of liquid soap from frustoconical inner volume 40 of lower portion 13 through opening 30 of tube portion 20.

Valve 15 may include a handle 16 and a ball valve 22, wherein rotation of handle 16 rotates ball valve 22 between a closed position and an open position. In the closed position, ball valve 22 inhibits flow of liquid soap through tube portion 20. In the open position, ball valve 22 allows flow of liquid soap through tube portion 20.

In some embodiments, the liquid soap dispenser container has a top portion that is located on a top surface of the countertop. In these embodiments, open space 26 is of a size and shape to receive the top portion dispenser container within the open space, thereby allowing tube portion 20 to extend into an opening of the dispenser container to fill the dispenser container. This ensures proper alignment of the filling device 10 with the dispensing container to allow for proper filling of the liquid soap dispensing container. Further, the dispensing end extending into the dispensing container prevents the filling device from sliding out of alignment during filling, particularly if there is accidental bumping of the countertop under which the dispensing container is installed.

In other embodiments, tube portion 20 has a dispensing end 28 that extends beyond the bottom surface 25 (not shown). This allows dispensing end 28 to extend into the liquid soap dispensing container while bottom surface 25 to rest on a counter top surface. This ensures proper alignment of the filling device 10 with the dispensing container to allow for proper filling of the liquid soap dispensing container. Further, the dispensing end extending into the dispensing container prevents the filling device from sliding out of alignment during filling, particularly if there is accidental bumping of the countertop under which the dispensing container is installed.

It will be understood that while shown in FIGS. 1-5 that the filling device 10 is cylindrical in shape, inner volume 27 being cylindrical in shape and inner volume 40 being frustoconical in shape, other shapes may be utilized. For example, and without limitation, the shape of the cross section of the device 10 and inner volume 27 may be square, rectangular, triangular, or any rectilinear shape, circular, or have may number of sides. Further the inner volume 40 may be any shape so long as surface 18 extends from a first opening 17 to a smaller second opening 19.

Figure 6:
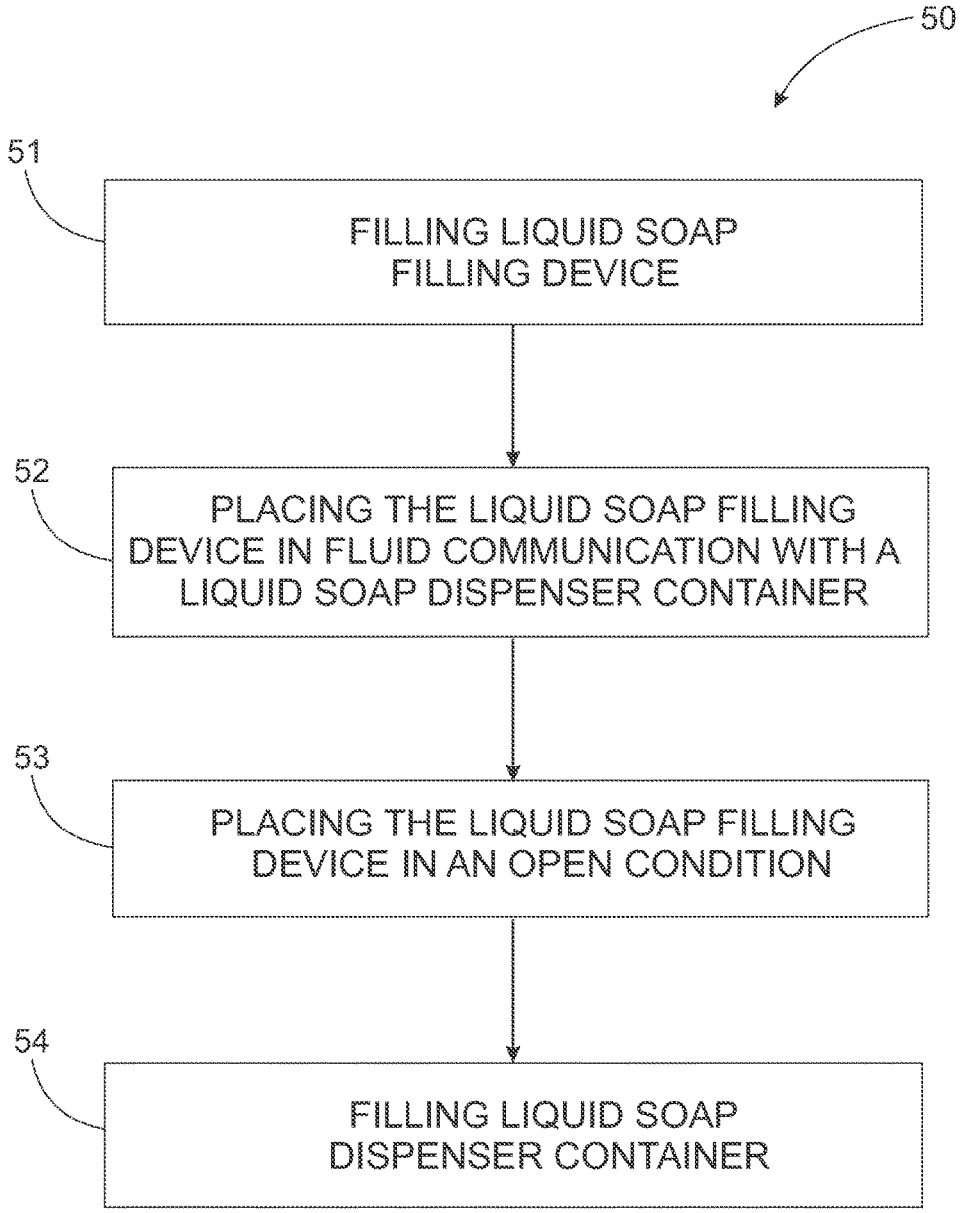
FIG. 6 is a flow chart showing a method of using a liquid filling device.

Referring again to the drawings, FIG. 6 depicts a method 50 of using a liquid soap filling device. The method 50 comprises filling the liquid soap filling device, with the liquid soap filling device in a closed condition with liquid soap until the liquid soap reaches a predetermined measured amount (Step 51); placing the liquid soap filling device in fluid communication with a liquid soap dispenser container installed under a countertop (Step 52); placing the liquid soap filling device in an open condition (Step 53); and filling the liquid soap dispenser container (Step 54).

Step 52 of placing the liquid soap filling device in fluid communication with the liquid soap dispenser container may comprise placing a bottom surface on a countertop to support the liquid soap filling device; and aligning a tube portion of the liquid soap filling device with an opening of the dispenser container installed under the countertop. In other embodiments, Step 52 of placing the liquid soap filling device in fluid communication with the liquid soap dispenser container may comprise placing a bottom surface on a countertop to support the liquid soap filling device; and extending a tube portion of the liquid soap filling device into an opening of the dispenser container installed under the countertop, wherein the tube portion extends through an opening in the countertop into the dispenser container.

The method 50 may also include maintaining the liquid soap filling device in the open condition until the premeasured liquid soap is all received within the dispenser container. The method 50 does not require human interaction during filling to ensure proper filling of the dispenser container.

It will be understood that the components defining any liquid soap filling device may be formed of any of many different types of materials or combinations thereof that can readily be formed into shaped objects provided that the components selected are consistent with the intended operation of a liquid soap filling device. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any liquid soap filling device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, 3D printing, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of using a liquid soap filling device; the method comprising:

filling the liquid soap filling device, with a valve of the liquid soap filling device in a closed condition, with liquid soap until the liquid soap reaches a predetermined measured amount;

placing the liquid soap filling device in fluid communication with a liquid soap dispenser container installed under a countertop, wherein placing the liquid soap filling device in fluid communication with the liquid soap dispenser container comprises placing a bottom surface on a countertop to support the liquid soap filling device;

placing the valve of the liquid soap filling device in an open condition; and filling the liquid soap dispenser container.

2. The method of claim 1, wherein placing the liquid soap filling device in fluid communication with the liquid soap dispenser container further comprises aligning a tube portion of the liquid soap filling device with an opening of the dispenser container installed under the countertop.

3. The method of claim 1, wherein placing the liquid soap filling device in fluid communication with the liquid soap dispenser container further comprises extending a tube portion of the liquid soap filling device into an opening of the dispenser container installed under the countertop, wherein the tube portion extends through an opening in the countertop into the dispenser container.

4. The method of claim 1, further comprising maintaining the valve of the liquid soap filling device in the open condition until the premeasured liquid soap is all received within the dispenser container.

* * * * *